US010283845B2

(12) United States Patent
Boerman et al.

(10) Patent No.: US 10,283,845 B2
(45) Date of Patent: May 7, 2019

(54) LOOP ANTENNA STRUCTURE WITH ONE OR MORE AUXILIARY ELECTRONIC ELEMENTS FOR USE IN AN ELECTRONIC DEVICE

(71) Applicant: Motorola Mobility LLC, Chicago, IL (US)

(72) Inventors: Joshua Boerman, Lake Zurich, IL (US); Junsheng Zhao, Vernon Hills, IL (US); Md Rashidul Islam, Lombard, IL (US); Young Hun Kim, Buffalo Grove, IL (US)

(73) Assignee: Motorola Mobility LLC, Chicago, IL (US)

( * ) Notice: Subject to any disclaimer, the term of this patent is extended or adjusted under 35 U.S.C. 154(b) by 72 days.

(21) Appl. No.: 15/279,369

(22) Filed: Sep. 28, 2016

(65) Prior Publication Data

US 2018/0090818 A1 Mar. 29, 2018

(51) Int. Cl.
*H01Q 1/24* (2006.01)
*H01Q 7/00* (2006.01)
(Continued)

(52) U.S. Cl.
CPC ..... *H01Q 1/243* (2013.01); *H01Q 1/42* (2013.01); *H01Q 1/50* (2013.01); *H01Q 7/00* (2013.01)

(58) Field of Classification Search
CPC ..... H01Q 1/243; H01Q 7/00; H01Q 1/44
See application file for complete search history.

(56) References Cited

U.S. PATENT DOCUMENTS 9,648,150 B1 5/2017 Zhao et al.
2009/0256759 A1 10/2009 Hill et al.
(Continued)

FOREIGN PATENT DOCUMENTS

WO 2017026712 A1 2/2017
WO 2017155797 A1 9/2017

OTHER PUBLICATIONS

Jun Zhao, et al., "One Piece Conductive Housing with Incorporated Antenna for Use in an Electronic Device", U.S. Appl. No. 15/235,065, filed Aug. 11, 2016.
(Continued)

*Primary Examiner* — Ricardo I Magallanes
(74) *Attorney, Agent, or Firm* — Lawrence J. Chapa

(57) ABSTRACT

The present application provides a housing for an electronic device sub-assembly for use in an electronic device having wireless communication capabilities. The electronic device sub-assembly includes a loop antenna structure having a conductive ground structure, and a conductive loop element separate from the conductive ground structure. The conductive loop element has two ends and a conductive path, which extends between the two ends a distance away from the conductive ground structure. The conductive loop element is coupled to the conductive ground structure at each of the two ends, and the distance that the conductive path of the conductive loop element extends away from the conductive ground structure encloses an area forming a loop which is internal to the loop antenna structure. The electronic device sub-assembly further includes a signal source coupled between the conductive loop element and the conductive ground structure across the loop for applying a drive signal. The electronic device sub-assembly still further includes one or more auxiliary electronic elements, where the one or more auxiliary electronic elements each have a primary purpose that is separate from the loop antenna structure. The one or
(Continued)

more auxiliary electronic elements each include a ground which is coupled to the conductive ground structure via the conductive loop element.

18 Claims, 5 Drawing Sheets

(51) Int. Cl.
*H01Q 1/42* (2006.01)
*H01Q 1/50* (2006.01)

(56) References Cited

U.S. PATENT DOCUMENTS

| | | | | |
|---|---|---|---|---|
| 2012/0009983 | A1 | 1/2012 | Mow et al. | |
| 2014/0111684 | A1 | 4/2014 | Corbin et al. | |
| 2016/0056527 | A1 | 2/2016 | Pascolini et al. | |
| 2016/0056531 | A1* | 2/2016 | Lee | H01Q 7/00 343/702 |
| 2016/0064820 | A1* | 3/2016 | Kim | H01Q 1/243 343/767 |

OTHER PUBLICATIONS

GB Search Report dated Mar. 15, 2018, for UK Patent Application No. GB1714885.9, which claims priority to U.S. Appl. No. 15/279,369, filed Sep. 28, 2016.

* cited by examiner

LOOP ANTENNA STRUCTURE WITH ONE OR MORE AUXILIARY ELECTRONIC ELEMENTS FOR USE IN AN ELECTRONIC DEVICE

FIELD OF THE APPLICATION

The present disclosure relates generally to electronic devices with an antenna, and more particularly, electronic devices where the antenna is co-located with auxiliary electronic elements.

BACKGROUND

Electronic devices, such as smartphones, are increasingly supporting use cases, where for certain functionality, it is desirable for the device to be able to support a larger display size. For example, larger display sizes can be desirable for viewing visual content as part of a media player or a browser, as well as for supporting the visual presentation of information as part of an application or program that is being executed by the device. However, such a trend needs to be balanced with a general desire for the overall size of the device to stay the same and even decrease in one or both of dimension and weight.

In an attempt to support larger display sizes without increasing the overall size of the device, device manufacturers have increasingly dedicated a larger percentage of the exterior surface to a display, where the display in many instances has grown in one or more dimensions to a size that dominates a particular surface, such as the front surface of the device. In at least some of these instances, the display has been allowed to extend into areas that had previously been used to support user inputs, such as areas of the surface that have previously supported a keypad, such as a numeric keypad.

Larger displays often mean larger openings in the housing, which can reduce the amount of material that is available to support the structural integrity of the housing, and correspondingly the device. As such, manufacturers are increasingly relying upon materials in the formation of the device housings, such as metals, that have historically better maintained structural integrity with less overall material. This is true for devices having a full metal rear housing, as well as devices that incorporate perimeter metal housings. However, housings made from conductive materials, such as metal, can interfere with the transmission and reception of wireless signals into and out of the device. Further openings can be made in the housing proximate the location of the antennas, which support wireless communication signal transmission/reception, in order to create an area through which wireless signaling can propagate. Alternatively, the antennas can be formed into the housing materials with cuts and/or further openings which isolate the antenna portions from the non-antenna portions of the housing. However, to the extent that cuts or further openings need to be made in the housing, the further openings and/or cuts can further affect the structural integrity. The further openings and/or cuts can also affect the aesthetics of the device.

In addition to the conductive structures associated with the housing, conductive structures associated with other auxiliary electronic elements can impact the functioning of a nearby antenna, which given the limited overall space constraints in some devices can present design challenges.

The present innovators have recognized that by aligning the ground structures of nearby auxiliary electronic elements with anticipated current flows in an antenna, and avoiding substantial encroachment within one or more voids, openings or windows in a conductive housing, which are used to support a radio frequency electromagnetic energy radiating and/or a radio frequency electromagnetic energy sensing structure, which is internal to the outer perimeter of the device, auxiliary electronic elements can be positioned proximate an antenna structure while reducing the negative effects on an antenna structure associated with the related conductive elements associated with the auxiliary electronic elements.

SUMMARY

The present application provides a housing for an electronic device sub-assembly for use in an electronic device having wireless communication capabilities. The electronic device sub-assembly includes a loop antenna structure having a conductive ground structure, and a conductive loop element separate from the conductive ground structure. The conductive loop element has two ends and a conductive path, which extends between the two ends a distance away from the conductive ground structure. The conductive loop element is coupled to the conductive ground structure at each of the two ends, and the distance that the conductive path of the conductive loop element extends away from the conductive ground structure encloses an area forming a loop which is internal to the loop antenna structure. The electronic device sub-assembly further includes a signal source coupled between the conductive loop element and the conductive ground structure across the loop for applying a drive signal. The electronic device sub-assembly still further includes one or more auxiliary electronic elements, where the one or more auxiliary electronic elements each have a primary purpose that is separate from the loop antenna structure. The one or more auxiliary electronic elements each include a ground which is coupled to the conductive ground structure via the conductive loop element.

In at least one embodiment, the conductive loop element is formed from at least part of a conductive outer band corresponding to a sidewall of a housing for the electronic device.

In at least a further embodiment, the respective grounds of the auxiliary electronic elements are coupled to the conductive ground structure via the conductive loop element following a route that extends along the path of the conductive loop element. In at least some of these instances, the respective grounds of the auxiliary electronic elements are coupled to the conductive ground along a route, which limits the intrusion into the enclosed area between the conductive path of the conductive loop element and the conductive ground structure.

These and other features, and advantages of the present disclosure are evident from the following description of one or more preferred embodiments, with reference to the accompanying drawings.

DETAILED DESCRIPTION OF THE PREFERRED EMBODIMENT(S)

Figure 2:
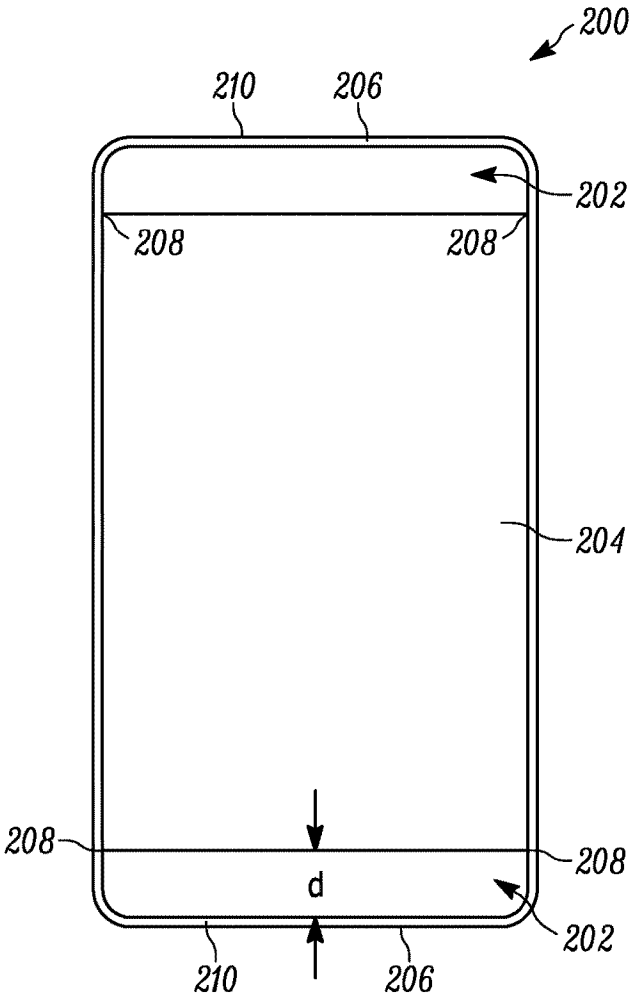
FIG. 2 is a front view of a loop antenna structure with one or more openings or windows.

While the present invention is susceptible of embodiment in various forms, there is shown in the drawings and will hereinafter be described presently preferred embodiments with the understanding that the present disclosure is to be considered an exemplification and is not intended to limit the invention to the specific embodiments illustrated. One skilled in the art will hopefully appreciate that the elements in the drawings are illustrated for simplicity and clarity and have not necessarily been drawn to scale. For example, the dimensions of some of the elements in the drawings may be exaggerated relative to other elements with the intent to help improve understanding of the aspects of the embodiments being illustrated and described.

Figure 1:
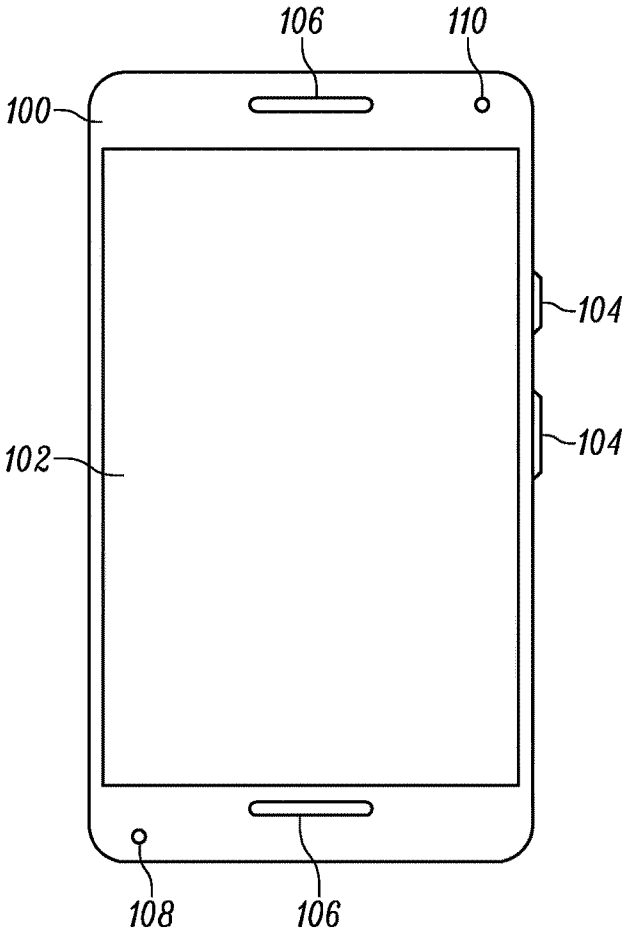
FIG. 1 is a front view of an exemplary wireless communication device.

FIG. 1 illustrates a front view of an exemplary wireless communication device 100, such as a wireless communication device. While in the illustrated embodiment, the type of wireless communication device shown is a radio frequency cellular telephone, other types of devices that include wireless radio frequency communication capabilities are also relevant to the present application. In other words, the present application is generally applicable to wireless communication devices beyond the type being specifically shown. A couple of additional examples of suitable wireless communication devices that may additionally be relevant to the present application in the incorporation and management of an antenna as part of the housing can include a tablet, a laptop computer, a desktop computer, a netbook, a cordless telephone, a selective call receiver, a gaming device, a personal digital assistant, as well as any other form of wireless communication device that might be used to manage wireless communications including wireless communications involving one or more different communication standards. A few examples of different communication standards include Global System for Mobile Communications (GSM) Code Division Multiple Access (CDMA), Orthogonal Frequency Division Multiple Access (OFDMA), Long Term Evolution (LTE), Global Positioning System (GPS), Bluetooth®, Wi-Fi (IEEE 802.11), Near Field Communication (NFC) as well as various other communication standards. In addition, the wireless communication device 100 may utilize a number of additional various forms of communication including systems and protocols that support a communication diversity scheme, as well as carrier aggregation and simultaneous voice and data signal propagation.

In the illustrated embodiment, the radio frequency cellular telephone includes a display 102 which covers a large portion of the front facing. In at least some instances, the display can incorporate a touch sensitive matrix, that can help facilitate the detection of one or more user inputs relative to at least some portions of the display, including an interaction with visual elements being presented to the user via the display 102. In some instances, the visual element could be an object with which the user can interact. In other instances, the visual element can form part of a visual representation of a keyboard including one or more virtual keys and/or one or more buttons with which the user can interact and/or select for a simulated actuation. In addition to one or more virtual user actuatable buttons or keys, the device 100 can include one or more physical user actuatable buttons 104. In the particular embodiment illustrated, the device has two such buttons located along the right side of the device.

The exemplary hand held electronic device, illustrated in FIG. 1, additionally includes a pair of speakers 106. The speakers 106 may support the reproduction of an audio signal, which could be associated with an ongoing voice communication or the playback of a streaming or stored media file, which can include a stand-alone signal, such as for use in the playing of music, or can be part of a multimedia presentation, such as for use in the playing of a movie, which might have at least an audio as well as a visual component. One or more of the speakers may also include the capability to also produce a vibratory effect. However, in some instances, the purposeful production of vibrational effects may be associated with a separate element, such as a rotary mass vibrator, which is positioned at an alternative location internal to the device.

In the present instance a pair of speakers can support the reproduction of stereophonic sound including both a left and a right channel associated with when the device is oriented in landscape mode, such as for viewing the playback of a movie. Otherwise, at least one of the speakers is located toward the top of the device, which corresponds to an orientation consistent with the respective portion of the device facing in an upward direction during usage in support of a voice communication. In such an instance, at least a corresponding one of the speakers 106 might be intended to align with the ear of the user, and at least one of one or more microphones 108 might be intended to align with the mouth of the user, which is often generally opposite the corresponding speaker 106 at a location at or proximate the bottom of the device. Also located near the top of the device, in the illustrated embodiment, is a front facing camera 110. The wireless communication device will also generally include one or more radio frequency transceivers, as well as associated transmit and receive circuitry, including one or more antennas that may be incorporated as part of the device 100.

FIG. 2 illustrates a loop antenna structure 200 with one or more openings or windows 202, which in at least some instances are referred to as radio-frequency (RF) windows. In the illustrated embodiment, the windows 202 are formed between a conductive ground structure 204, and a conductive loop element 206 separate from the conductive ground structure 204. More specifically, the conductive loop element 206 has two ends 208 and a conductive path 210, which extends between the two ends 208 a distance "d" away from the conductive ground structure 204. The conductive loop element 206 is coupled to the conductive ground structure at each of the two ends 208, and the distance "d" that the conductive path 210 of the conductive loop element extends away from the conductive ground structure 204 encloses an area forming a loop or window 202 which is internal to the loop antenna structure 200. The conductive loop element 206 generally provides an uninterrupted electrical path away from the conductive ground structure 204 via which electrical currents can flow, which extends around the perimeter of the opening or window 202.

In the illustrated embodiment, the conductive loop element 206 in at least some instances can be part of a conductive side housing band, that extends around the perimeter and forms part of the housing of the device 100. The conductive ground structure 204, in at least some instances, can be part of a printed circuit substrate, such as in the form of a ground plane and/or a circuit shield. The printed circuit substrate can be used to receive electrical elements including electronic circuitry, components and/or modules, as well as conductive traces for interconnecting the electrical elements. In some of the same or other instances, the conductive ground structure 204 can be part of a conductive housing, which can provide structure and support for the device 100, where some or all of the conductive ground structure 204 could be part of an internal frame work and/or part of an external surface, such as a back side surface, relative to the overall device 100.

In at least some instances, the conductive side housing band and/or the conductive ground structure is formed from metal, and allows for a uni-body metal construction having a seamless metal outer edge (side housing band), which coincides with the surrounding sidewall of the device 100. Openings can exist in the outer edge (side housing band), which allows for features such as the placement of physical user actuatable buttons 104, as well as various other porting, such as for headphone jack, microphone ports, connector ports, and memory card slots. While the conductive ground structure 204 can coincide with an external surface such as the back side surface of the device. Alternatively, the housing body of the device 100 can receive one or more additional material layers, such as a decorative plastic or wood back panel, thereby placing at least some portions of the housing body closer to an interior space of the device 100. On the front of the device a plastic or glass lens cover can extend beyond the boundaries of the display 102 to provide a more uniform look and an area under which the windows 202 can be located without a conductive structure interfering with the transmission and/or reception of radio frequency signals.

In the illustrated embodiment, the housing body of the device 100 is substantially rectangular in shape and has two sets of opposing sides corresponding to an outer edge, a first set and a second set of opposing sides, where the first set of sides are longer than the second set of opposing sides. However, while the housing body of the device 100 in the illustrated embodiment is substantially rectangular in shape, there is no requirement that the shape be rectangular. In the illustrated embodiment, two windows 202 are each respectively located proximate a corresponding one of the shorter pair of opposing sides of the housing body. Further, the windows 202, in at least the illustrated embodiment, are located in the area proximate the outer edge of the housing body between the end of the display 102 and the end of the device 100. Locating the windows proximate the ends, places the windows 202 further away from display 102 which could affect radio frequency transmissivity. This also creates an area between the windows 202 proximate the back of the device 100 where a coil structure can be located, that can be used to support near field communications and/or wireless charging.

Figure 3:
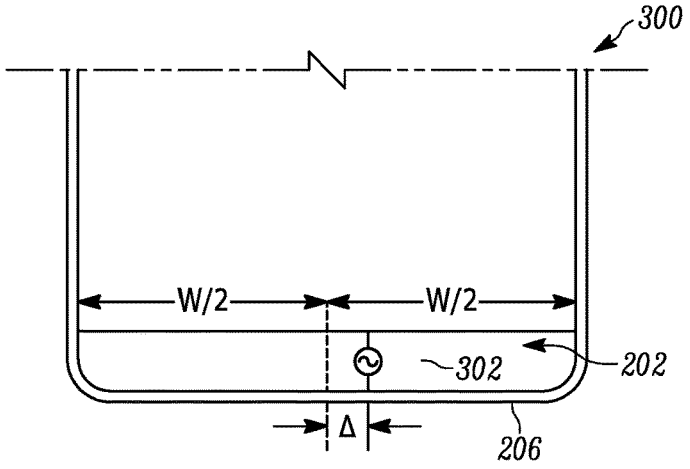
FIG. 3 is a front view of the loop antenna structure including one of the one or more openings or windows.

FIG. 3 illustrates a partial front view 300 of the loop antenna structure 200 and one of the one or more openings or windows 202. In the illustrated embodiment, at least one drive signal 302 is applied across the windows 202. More specifically, the drive signal 302 is applied across a first pair of opposing sides associated with the perimeter of the window 202. In the illustrated embodiment, the shape of the window is generally rectangular, where a first pair of opposing sides are longer than a second pair of opposing sides. In at least some instances, the drive signals can include a single direct contact from a printed circuit substrate including the transmit and/or receive circuitry to the conductive loop element 206 thereby providing a common mode feed for supporting wireless communications including cellular and near field communications. While in some instances, the single direct contact can coincide with a point that is substantially centered relative to the window, as illustrated by a dashed line, in other instances, the single direct contact can be offset by an exemplary amount and in an exemplary direction, identified by the character "Δ". In at least some circumstances, an offset or slightly off-center feed can result in a radiating structure, which has wider high-band resonant modes.

Figure 4:
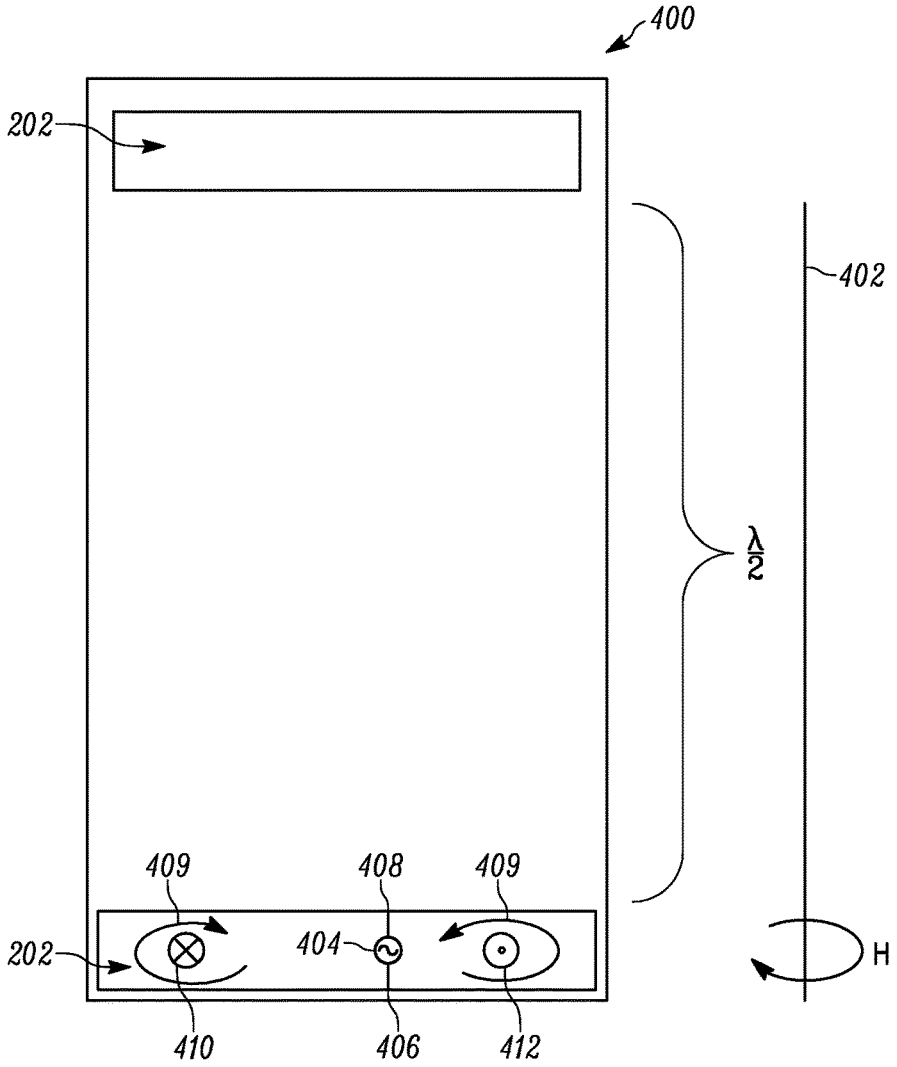
FIG. 4 is a schematic view of the radiating structure included in the exemplary wireless communication device, and the corresponding electrical approximation.

FIG. 4 illustrates a schematic view 400 of the radiating structure, namely the window 202, included in the exemplary wireless communication device 100, and the corresponding electrical approximation 402. In the illustrated embodiment, a drive signal 404 is shown being applied across one of the windows 202, slightly off-center, and more specifically across the longer ones of the two pairs of opposing sides of the perimeter of the rectangular shaped window 202. Correspondingly, the drive signal will alternatively induce a positive and a negative current in the directions of the two arrows 409, where the current will flow from a first one 406 of the points where the source is coupled to the perimeter around the window to the second one 408 of the points where the source is coupled to the perimeter. Such an embodiment forms what is sometimes referred to as a dual loop antenna configuration. When the single direct contact is slightly off-center, this can result in two slightly different sized loops with one loop being larger than the other.

Because the prominent direction in which the current flows along the long side of perimeter of the window 202 is in opposite directions in the respective loops, the currents 409 contribute to a substantial cancelation in the associated electric fields. However, each respective loop induces a corresponding magnetic field 410 and 412 having an opposite direction, where the magnetic fields that are produced will change direction with a change in the polarity of the drive signal 404 being applied across the respective points 406 and 408 of the perimeter of the opening 202. The magnetic fields, which are produced have a direction, which is largely into and out of the page. The resulting magnetic field will induce a current in the rest of conductive housing body 200. In essence, the conductive housing body for certain frequencies will function as a half wavelength dipole in a lengthwise direction, which is driven by the magnetic fields being produced. For many handheld devices, the size of the conductive housing body in combination with the magnetic drive fields supports reasonably good efficiencies in the bands around 800 MHz.

Figure 5:
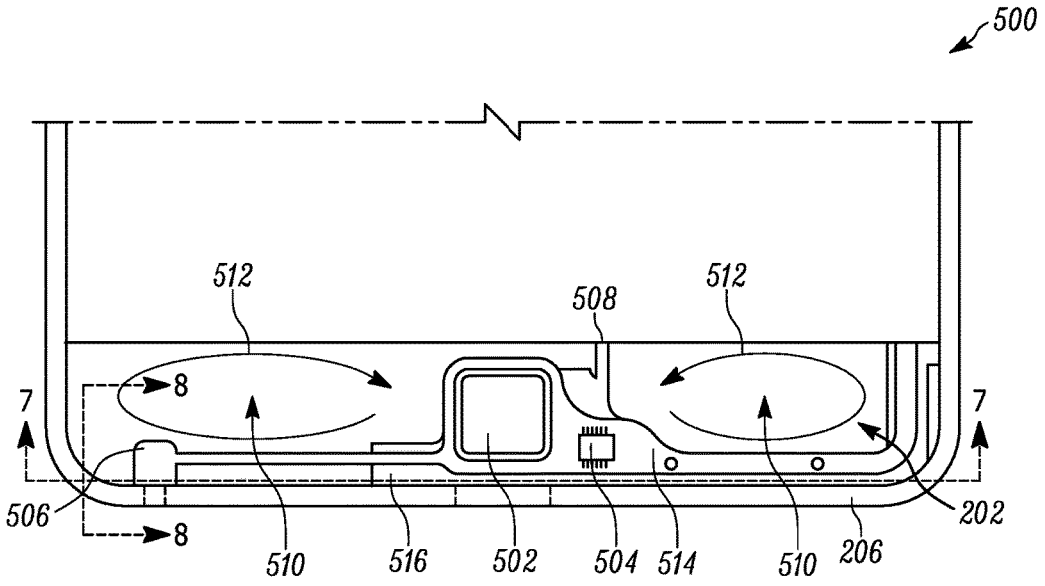
FIG. 5 is a partial front view including one or more auxiliary electronic elements in addition to the loop antenna structure.

FIG. 5 illustrates a partial front view 500 of the loop antenna structure 200 additionally including one or more auxiliary electronic elements. More specifically, the partial front view 500 further includes a finger print sensor 502 and associated control circuitry 504. The partial front view 500 still further includes additional auxiliary elements 506, which can include one or more of a microphone, a headset jack, an IR sensor, or alternative auxiliary electronic element. The auxiliary electronic elements are positioned proximate the periphery of one or more of the pair of loops formed through a signal feed point 508 being located across the window 202. By placing the auxiliary electronic elements proximate the periphery, an open space 510 in each of the loops can be maintained around which the expected currents 512 associated with the windows being used as an antenna can flow, when radiating or receiving a wireless signal.

Any signaling associated with the auxiliary electronic elements, are similarly arranged to follow a position that is proximate the periphery of the window 202 including any ground connections. The placement and positioning of the auxiliary electronic elements, and associated signaling can be facilitated through the use of one or more circuit substrates, which are sized and shaped to follow the outer perimeter of the window 202. In at least the illustrated embodiment, a pair of circuit substrates are used, and include a flex circuit substrate 514, and a more rigid printed circuit substrate 516. In the illustrated embodiment, the finger print sensor 502 and related control circuitry 504, as well as one or more of the additional auxiliary elements 506 are associated with the flex circuit substrate 514, whereas the signal feed point 508 is associated with the more rigid printed circuit substrate 516. As ground signals associated with the auxiliary electronic elements extend around proximate the periphery of the window 202, the ground signals can couple to the conductive loop element 206, at multiple locations along the conductive path 210. In at least some instances, each connection could be facilitated through the use of a conductive tab, which can extend from the conductive loop 206 to each of the corresponding ground connection points of the respective circuit substrates.

Figure 6:
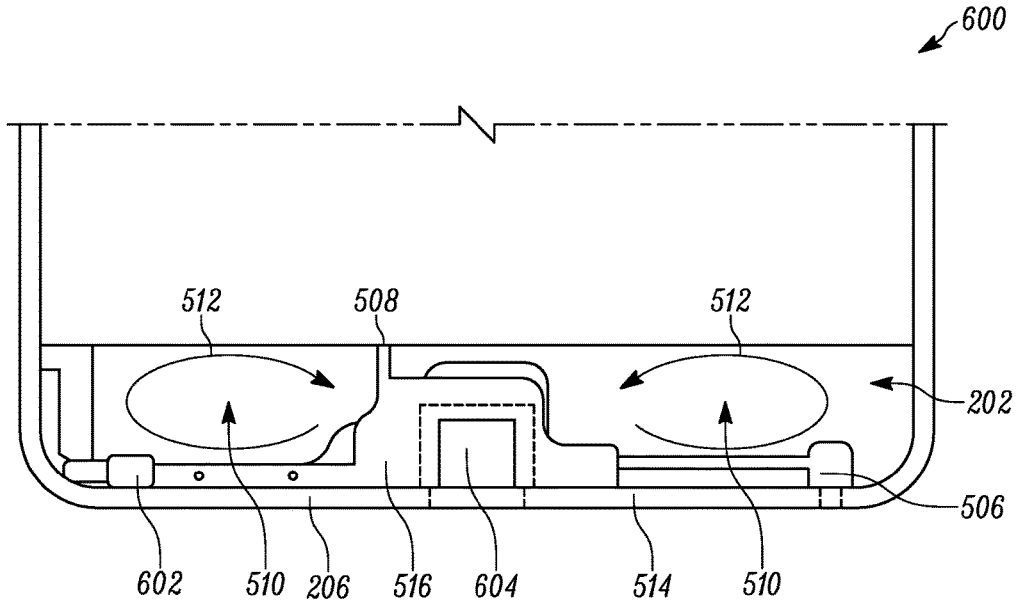
FIG. 6 is a partial back view including one or more auxiliary electronic elements in addition to the loop antenna structure.

FIG. 6 illustrates a partial back view 600 including one or more auxiliary electronic elements in addition to the loop antenna structure 200. In the illustrated embodiment, from the back side perspective, one can better see a rotary mass vibrator 602, and a connector for receiving an external cable or another connector, such as a Universal Serial Bus (USB) connector 604. In at least some instances, the position of a vibrational element proximate a corner of the device 100 can enhance the performance of the same. Furthermore, users have grown accustomed to a USB type connection proximate the bottom of many types of hand held electronic devices such as cellular telephones. In the illustrated embodiment, the rotary mass vibrator 602 and the USB type connector 604 are associated with the more rigid printed circuit substrate 516. The USB type connector 604 may also make a connection with the flex circuit substrate 514.

By following the periphery of the window 202, the routed grounding signal connections associated with the circuit substrate and the grounded structures of the auxiliary electronic elements become part of the antenna structure including the conductive loop element 206, and can be used to support a current path associated with a received or radiated wireless signal.

Figure 7:
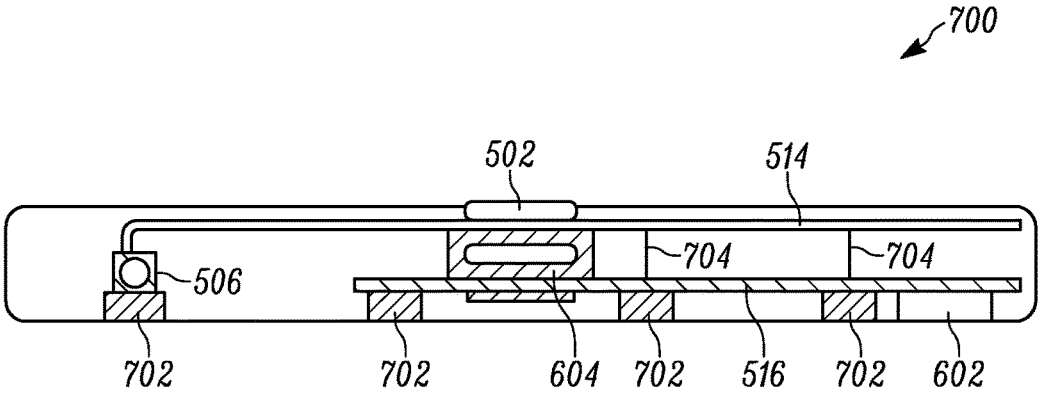
FIG. 7 is a cross sectional bottom view of an exemplary wireless communication device including one or more auxiliary electronic elements in addition to the loop antenna structure.

FIG. 7 illustrates a cross sectional bottom view 700 of an exemplary wireless communication device 100 and shows the positioning and placement of one or more auxiliary electronic elements in the area proximate to the loop antenna structure 200. More specifically, the bottom view 700 helps illustrate an exemplary stacked arrangement including a pair of circuit substrates including the flex circuit substrate 514 and the more rigid printed circuit substrate 516. The bottom view additionally shows how one or more tabs 702 or standoffs could be used to couple the conductive loop element 206 to one or more of the circuit substrates and/or to one or more of the auxiliary electronic elements. The tabs 702 or standoffs could provide a shelf coupled to or formed as part of the conductive loop element 206 that extends from the periphery of the window 202 toward the internal open space 510 associated with the window 202. The tabs could extend from the sidewall and/or from the front or back side of the device. In at least some instances, all or part of the tabs 702 would be conductive to enable current to flow between the conductive loop element 206, and the one or more circuit substrates and/or the one or more auxiliary electronic elements. Still further, one or more connections 704 can exist between the flex circuit substrate 514 and the more rigid printed circuit substrate 516 at various points along their lengths to facilitate various connections including connections between the respective grounds.

Similar to the USB type connector 604 or finger print sensor 502, a camera module could also be arranged proximate a loop antenna structure 200 located at either the top or bottom of the device. By accommodating one or more auxiliary electronic elements in an area reserved for one or more of the antennas, space in other areas within the device are freed up for other purposes, and/or the overall size of the device can be made smaller. This can be helpful where several of the device elements prefer to be positioned in an area outside the footprint of the display.

Figure 8:
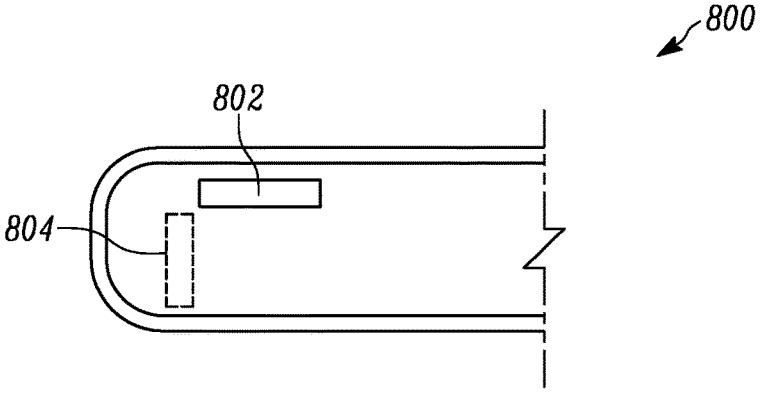
FIG. 8 is a partial cross sectional side view illustrating multiple possible arrangements of a circuit substrate within a housing proximate the bottom of an exemplary wireless communication device.

FIG. 8 illustrates a partial cross sectional side view 800 illustrating multiple possible arrangements of a circuit substrate within a housing proximate the bottom of an exemplary wireless communication device. While the circuit substrates, in the illustrated embodiments have been generally shown in a more horizontal arrangement 802, substantially parallel to the front or back facing of the device, it is possible that all or parts of one or more of the circuit substrates could be alternatively oriented in a more vertical arrangement 804 without departing from the teachings of the present application.

In many instances, in addition to ground signals, some or all of the auxiliary electronic elements will need to support non-ground signals. However, while the ground signals can be more readily integrated into the loop antenna structure 200 without significant negative impact. The handling of non-ground type signals can require more of an effort, so as to minimize their affect on the antenna type structures. For example, it may be beneficial to create shielded areas within which the non-ground type signals can be routed, so as to minimize the potential for any adverse effects on the functioning of the loop antenna structure.

Figure 9:
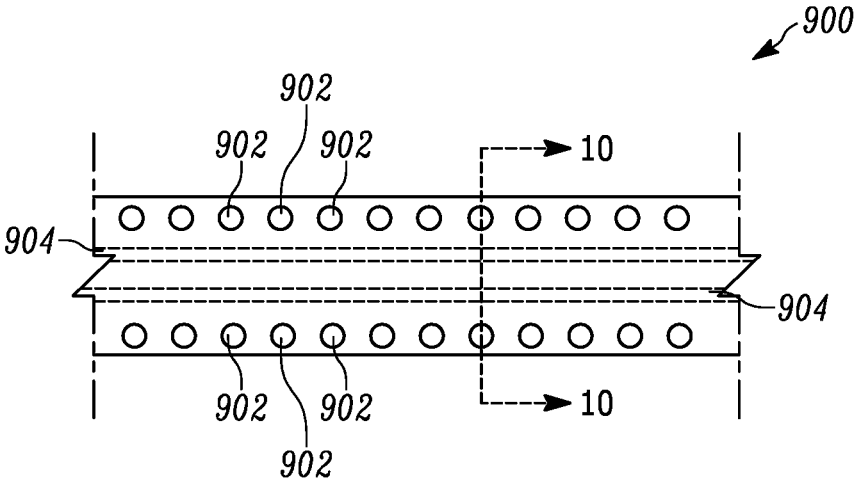
FIG. 9 is a partial top view of an exemplary circuit substrate.
Figure 10:
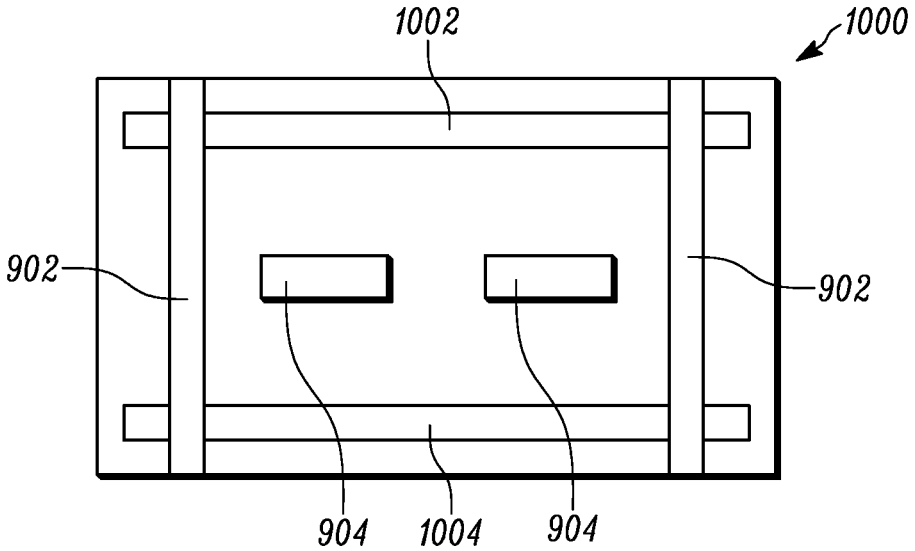
FIG. 10 is a cross sectional side view of the exemplary circuit substrate illustrated in FIG. 9.

FIGS. 9 and 10 illustrate a partial top view 900 and a corresponding side view 1000 of an exemplary circuit substrate through which non-ground type signals can be routed. In the illustrated embodiment, a multi-layer circuit substrate is provided, where at least the stacked top 1002 and bottom 1004 layers consist of a grounded plane, which along a distance include two or more rows of vias 902, that couple the top ground layer 1002 to the bottom ground layer 1004. One or more traces of non-grounded signals 904 can then be placed in the area between the top and bottom ground layers, as well as between the two or more rows of vias 902. In some instances the ground which is used to shield the non-grounded signals will be different from the ground type signals that are coupled to the loop antenna structure 200. In this way a shielded space can exist within the area associated with the loop antenna structure, which can help to isolate the two sets of signals so as to minimize their effect on one another.

While the preferred embodiments have been illustrated and described, it is to be understood that the invention is not so limited. Numerous modifications, changes, variations, substitutions and equivalents will occur to those skilled in the art without departing from the spirit and scope of the present invention as defined by the appended claims.

What is claimed is:

1. An electronic device sub-assembly for use in an electronic device having wireless communication capabilities, the electronic device sub-assembly comprising: a loop antenna structure including a conductive ground structure, and a conductive loop element separate from the conductive ground structure, the conductive loop element having two ends and a conductive path, which extends between the two ends a distance away from the conductive ground structure, where the conductive loop element is coupled to the conductive ground structure at each of the two ends, and where the distance that the conductive path of the conductive loop element extends away from the conductive ground structure encloses an area forming a loop which is internal to the loop antenna structure; a signal source coupled between the conductive loop element and the conductive ground structure across the loop for applying a drive signal; and one or more auxiliary electronic elements, where the one or more auxiliary electronic elements each have a primary purpose that is separate from the loop antenna structure, where the one or more auxiliary electronic elements each include a ground which is coupled to the conductive ground structure via the conductive loop element; wherein the respective grounds of the auxiliary electronic elements are coupled to the conductive ground structure via the conductive loop element following a route that extends along the path of the conductive loop element; and wherein the respective grounds of the one or more auxiliary electronic elements are coupled to the conductive ground structure along the route, which is outside of the area forming the loop between the conductive path of the conductive loop element and the conductive ground structure that is internal to the loop antenna structure.

2. An electronic device sub-assembly in accordance with claim 1, wherein the conductive loop element is formed from at least part of a conductive outer band corresponding to a sidewall of a housing for the electronic device.

3. An electronic device sub-assembly in accordance with claim 2, wherein the conductive ground structure is part of a circuit substrate, which is coupled to the conductive outer band.

4. An electronic device sub-assembly in accordance with claim 1, wherein the conductive ground structure is part of a housing for the electronic device.

5. An electronic device sub-assembly in accordance with claim 1, wherein the signal source is coupled across a central section of the area forming the loop which is internal to the loop antenna structure.

6. An electronic device sub-assembly in accordance with claim 5, wherein the signal source bisects the area forming the loop which is internal to the loop antenna structure.

7. An electronic device sub-assembly in accordance with claim 5, wherein the signal is coupled across the central section of the area in a location that is off center, so as to form a first larger sub-area and a second smaller sub-area.

8. An electronic device sub-assembly in accordance with claim 7, wherein the one or more auxiliary electronic elements are positioned more proximate the second smaller sub-area.

9. An electronic device sub-assembly in accordance with claim 1, wherein the route is part of a secondary circuit substrate, which is at least one of flexible or rigid.

10. An electronic device sub-assembly in accordance with claim 1, wherein at least some of the signaling between the one or more auxiliary electronic elements and circuits present on or near the conductive ground structure is routed through a conduit formed between a set of one or more conductive structural elements electrically coupled to the conductive ground structure.

11. An electronic device sub-assembly in accordance with claim 1, wherein the one or more auxiliary electronic elements are positioned in a location, which coincides with one or more of the conductive path of the conductive loop element, a location of the signal source, and a route of the coupling of the signal source across the loop.

12. An electronic device sub-assembly in accordance with claim 1, wherein the one or more auxiliary electronic elements include one or more connectors for receiving an external cable.

13. An electronic device sub-assembly in accordance with claim 1, wherein the one or more auxiliary electronic elements include one or more sensors.

14. An electronic device sub-assembly in accordance with claim 1, wherein the one or more auxiliary electronic elements include a microphone.

15. An electronic device sub-assembly in accordance with claim 1, wherein the one or more auxiliary electronic elements include a haptic feedback device.

16. An electronic device sub-assembly in accordance with claim 1, wherein the one or more auxiliary electronic elements include a camera assembly.

17. An electronic device sub-assembly in accordance with claim 1, wherein the electronic device sub-assembly is positioned at the bottom of the device outside a footprint of a display.

18. An electronic device sub-assembly in accordance with claim 1, wherein the electronic device is a hand held cellular radiotelephone.

* * * * *